United States Patent [19]

Sharpe, Jr. et al.

[11] 4,040,984

[45] Aug. 9, 1977

[54] ELECTROCONDUCTIVE POLYSALT COMPLEXES

[75] Inventors: Andrew Jackson Sharpe, Jr., McMurray; Robert H. Windhager, Pittsburgh; Kathleen Seese Hearp, Trafford, all of Pa.

[73] Assignee: Calgon Corporation, Pittsburgh, Pa.

[21] Appl. No.: 735,857

[22] Filed: Oct. 27, 1976

Related U.S. Application Data

[63] Continuation of Ser. No. 576,901, May 12, 1975, abandoned.

[51] Int. Cl.[2] ..... H01B 1/00

[52] U.S. Cl. ..... 252/500; 260/29.7 H

[58] Field of Search ..... 252/500, 501; 260/29.7 H, 89.7 N

[56] References Cited

U.S. PATENT DOCUMENTS

| | | | |
|---|---|---|---|
| 3,544,318 | 12/1970 | Boothe et al. | 96/1.5 |
| 3,660,338 | 5/1972 | Economou | 260/29.6 NR |
| 3,806,485 | 4/1974 | Frisque | 260/29.6 NR |

FOREIGN PATENT DOCUMENTS

| | | |
|---|---|---|
| 1,407,350 | 9/1975 | United Kingdom |

*Primary Examiner*—Benjamin R. Padgett
*Assistant Examiner*—E. Suzanne Parr
*Attorney, Agent, or Firm*—Rudolph J. Anderson, Jr.; Harry E. Westlake, Jr.; Martin L. Katz

[57] ABSTRACT

Cationic, electrically conductive polymers are mixed with multifunctional anionic compounds and/or anionic polymers to form a polysalt complex which exhibits markedly improved properties. Specifically, solvent holdout to parafinic solvents and to toluene are considerably improved, and the tackiness of the resulting film is notably decreased. The polysalt products also exhibit very good filmability on plastic substrates whereas the cationic polymer alone normally forms very poor films on such substrates.

6 Claims, No Drawings

ELECTROCONDUCTIVE POLYSALT COMPLEXES

This is a continuation of application Ser. No. 576,901 filed May 12, 1975, now abandoned.

BACKGROUND OF THE INVENTION

Electroconductive polymers are widely used to conductivize various substrates. The best known use of this type is in the manufacture of paper for electrostatographic reproductions. In this, the most common application for electroconductive polymers, the polymer is utilized in a conductive coating formulation which is applied to a paper substrate and subsequently overcoated with a photoconductor layer such as zinc oxide. The product paper subsequently is employed reproduction via an electrostatographic type process.

Prior to the present invention, it has been known to make electroconductive paper through the use of certain conductive cationic polymers such as homopolymers of di methyl diallyl ammonium chloride (see Boothe et al., U.S. Pat. No. 3,544,318) and polymers of other quaternized ammonium compounds such as described in Schaper et al., U.S. Pat. No. 3,486,932.

It is widely recognized that the most important criteria for selecting a conductivizing agent for use in manufacturing conductivized paper or other conductivized substrates include (1) conductivity; (2) filmability; (3) holdout to solvents employed in the manufacturing and use processes of the conductivized substrate (toluene and kerosene in the case of electrostatographic papers); and (4) low tack. Those skilled in the art of employing these conductive agents in the manufacture of conductivized substrates, such as conductive papers, are aware of the need and desirability for improvement in these properties, i.e. the need for increased conductivity and solvent holdout; the need for improved filmability; and/or the need for decreased tack.

It has been recognized also that the electroconductive paper industry advantageously could employ a water insoluble conductive polymer; it being known, of course, that the substantially linear polyelectrolytes now commonly employed in electroconductive paper manufacture, poly-(dimethyl diallyl ammonium chloride) and poly-(vinyl benzyl trimethyl ammonium chloride) for example, are highly water soluble. The water solubility of the electroconductive layer makes it necessary, in present manufacturing procedures, to apply the photoconductive coating formulation (usually zinc oxide together with binders, etc.) from an organic solvent based slurry. It would be desirable, of course, to apply the photoconductive coating from an aqueous-based slurry so as to minimize the need for expensive solvent recovery units and to more easily comply with current and proposed environmental pollution control standards. Use of a water insoluble conductive polymer would permit conversion, at least in part to aqueous systems.

It is well-known that such water soluble linear polyelectrolytes may be made less soluble, or even water insoluble, via covalent cross-linking. However, as the degree of cross-linking is increased, the polymer solution becomes unworkable and gel-like. Thus the cross-linked polymer becomes unworkable before the desired property of decreased solubility is achieved. As used herein, the term, "covalent cross-linking", refers to cross-linking of polymer chains to form a 3-dimensional network via a general mechanism wherein the cross-link is comprised of covalent bonds. Examples of this type of cross-linking are (1) a polymerization reaction in which a multifunctional monomer is employed which is capable of entering into the polymerization reaction to become a part of more than one polymer chain and/or (2) a relatively simple difunctional (or multifunctional) composition which is capable of reacting with pendant functional groups carried on polymer chains to form a covalently bonded bridge. In either case, when the concentration of the cross-linking agent exceeds about 0.5 percent, it may be assumed that the polymer solution will contain substantial gel particles and, at higher concentrations, will become an unworkable, essentially continuous gel. Often, such polymers actually become continuous and unworkable gels at degrees of cross-linking even less than 0.5 percent.

As is known to those skilled in the arts of the manufacture of polymers and of electrographic paper, attempts to develop cross-linkable, and therefore water insolulizable conductive polymers according to the afore described technology have been largely unsuccessful. The extremely low degree of cross-linking necessary to convert the polymer to unworkable form has lead to significant problems such as (1) very limited shelf life; (2) products which are susceptable to premature cross-linking which can cause severe inefficiencies and waste in the manufacture of the conductivized paper.

An alternate approach to the formation of insolublizable conductive polymers is via the mechanism of ionic bonding. Schaper et al., U.S. Pat. No. 3,579,613, and Michaels, Ind. Eng. Chem., Vol. 57, No. 10, pp. 32 *ff*, October 1965, have investigated one aspect of this approach. These researchers prepared the polysalt complexes, both stoichiometric and non-stoichimetric, of a polymer containing strongly anionic pendant groups (typically sulfonated acrylates and sulfonated polystyrene) and a polymer containing strongly cationic pendant groups (typically polydimethyl diallyl ammonium chloride and poly-vinyl benzyl trimethyl ammonium chloride). As noted by Michaels, similar polysalt complexes prepared from weakly acidic polyanions and weakly basic polycations yielded gel-like or quasi-liquid coacervates of indefinite chemical composition and high water content with little demonstrable utility. The properties of the polysalt complexes formed from strong acids and strong bases, however, were extensively investigated.

Results of the Michaels work showed that the polysalt complex formed from the interaction of strongly acidic polyanions and strongly basic polycations precipitates from (i.e. is insoluble in) common solvents and exhibits surprisingly high d.c. resistivity. These otherwise intractable polysalt complexes were found to be soluble in selected ternary solvent mixtures comprised of water, a water miscible organic solvent such as acetone and a strongly ionized simple electrolyte such as sodium bromide. The solubilized polysalt was a transparent, homogeneous, viscous sirup.

While polysalt complexes of the type disclosed by Michaels (those formed from the interaction of the polymer of a strongly acidic moiety and the polymer of a strongly basic moiety) show utility in several areas, the most prevalent uses employ the polysalt complex as a solid (note Michaels, U.S. Pat. No. 3,271,496 and Michaels et al., U.S. Pat. No. 3,276,598). For example, the polysalt complex when doped with concentrated electrolyte can be dispersed as a fine powder in plastics to impart antistatic properties or it can be formed as a film and utilized as battery separators, fuel cell membranes, or dialysis membranes and the like.

Further, polysalt complexes of the strong acid-strong base type, after special treatment, have been applied by Michaels to certain substrates and dried to yield a transparent, conductive coating. Although these polysalt complexes, when free of extraneous electrolyte, showed high d.c. resistivity, it was found that when the complexes were equilibrated with highly concentrated electrolyte solutions they become effective d.c. conductors. The use of such electrolyte doped polysalt comples solutions has been proposed in the manufacture of conductive coatings (note also Dolinsky and Dean, Chem. Tech., pp. 304 ff, May 1971).

The Michaels polysalt complex, however, suffers major deficiencies in application to electroconductive coating manufacture. Its high d.c. resistivity absent doping; its lack of solubility in common solvents and the very limited conditions under which it may be solubilized mitigate against its usefulness in many electroconductive coating applications. The fact that such polysalt complexes are soluble only under very selected conditions limits their utility in any area which requires the use of polymer solutions. For example, such polysalt complexes could not be used readily in the manufacture of electroconductive papers by present standard procedures which involve formulation of the conductive polymer into an aqueous slurry of a pigment such as clay, calcium carbonate, etc., and binder system such as hydroxy ethylated starch, polyvinyl alcohol, various synthetic latices, etc. The strong acid-strong base polysalt complex could not be employed in such procedure since (1) variation in the aqueous part of the ternary solvent system encountered in formulation would cause precipitation of the polysalt; (2) the electrolyte doping and the electrolyte used in the ternary solvent system for the polysalt is an undesired component in the coating formulation; and (3) the use of the required water-miscible organic solvent would require resort to solvent recovery units in order to meet environmental pollution control standards.

More recently, liquid polysalt complexes have been prepared from mixtures of anionic polyelectrolytes and cationic polyelectrolytes wherein at least one of the polyelectrolytes is weak (see Economou, U.S. Pat. No. 3,660,338). These polysalt complexes have found utility as dry strength agents in paper manufacturing when employed in combination with a water soluble ionization suppressor designed to prevent coacervation of the polysalt in water in concentrations of between 1 and 10 percent.

Thus, up to the present, polysalt complexes have been prepared as suspensions or sols which, with coacervation, may form gels, or three-dimensional water and hydrocarbon liquid insoluble gel-like structures.

SUMMARY OF THE INVENTION

The instant invention is based upon the discovery that polysalt complexes formed by ionic bridging or cross-linking between a water soluble, strongly cationic quaternary ammonium polymer and a weakly anionic multifunctional compound and/or a weakly anionic polymer are highly conductive products which may be applied to a variety of substrates and dried to yield a transparent electroconductive coating. Surprisingly, Applicants have found that such polysalt complexes display a high d.c. conductivity without resort to the electrolyte doping required in the electroconductive polysalt complexes of the prior art.

The electroconductive polysalt complexes of this invention are distinctly different from the electroconductive polysalt complexes disclosed in the prior art. The polysalt complexes described herein are of a specific class; being formed by the interaction of a polymer containing strongly basic moieties with a polymer containing weakly anionic moieties and/or a multifunctional weakly acidic compound. And the polysalt complexes of this invention form clear, stable, homogeneous aqueous solutions, as will be described hereinafter in more detail.

The products and procedures of the instant invention provide several distinct advantages over materials and practices noted in the prior art. Since the polysalt complexes of the present invention form stable, homogeneous aqueous solutions, rather than unstable suspensions subject to coacervation, or gels, they possess storage stability, are readily coated or filmed upon a variety of substrates, and can be introduced into a number of aqueous systems with ease. Surprisingly, it has been found that the polysalt complexes of this invention may be formed (the anionic and cationic components may be ionically cross-linked) in a pigmented slurry of the type used in the manufacture of conductivized paper without causing any detrimental effect such as clumping, gel formation or large viscosity increase. The polysalt complexes of this invention may be employed in such applications, therefore, without detrimental effect and do not require resort to expensive equipment such as solvent recovery facilities. Further, the use of the polysalt complexes of this invention leads to distinct advantages in the resulting conductivized products. Coatings, either pigmented or non-pigmented, made with these polysalt complexes exhibit considerably reduced tack as compared to the unmodified cationic polymers heretofore used. Also the polysalt complexes of this invention exhibit very good filmability on synthetic substrates such as MYLAR (polyethylene glycol terephthalate), nylon (copolymer of aliphatic dicarboxylic acids and aliphatic diamines), polyethylenes etc., whereas the filmability on such substrates of the unmodified cationic copolymer is virtually non-existant. Practice of this invention also results in notably increased holdout to organic solvents (parafinic and/or aromatic), a highly desirable improvement for applications in the manufacture of electroconductive paper.

While polysalt complexes of the present invention have been described as exhibiting particularly advantageous properties as electroconductive polymers, and in the manufacture of conductivized paper, there is no intention to thereby limit the present invention to such a merely preferred application. Rather, the polysalt complexes of the present invention would be useful as static suppressing agents, and in many other applications readily apparent from their superior properties described herein.

DESCRIPTION OF PREFERRED EMBODIMENTS

In its composition aspect, therefore, the instant invention may be described as residing in the concept of electroconductive polysalt complexes formed by the ionic cross-linking of a water soluble strongly cationic quaternary ammonium polymer with a water soluble, weakly anionic material selected from the group consisting of a water soluble, weakly anionic polymeric carboxylic acid and a water soluble, weakly anionic multifunctional carboxylic acid or mixtures thereof; said weakly anionic components characterized by having a pK value greater than 3; and wherein the ratio of equivalents of the anionic component to the cationic component is about 0.01 to 10.0, and the polysalt complex forms a stable, homogeneous aqueous solution. It is contemplated that such polysalt complexes, or formulations containing them as an essential electroconductive component, will be employed as an electroconductive element in the manufacture of conductivized products.

The descriptive expression "stable, homogeneous aqueous solution", used herein with reference to the polysalt complexes of this invention, denotes the formation of a solution of the polysalt complex in aqueous media, which solution is characterized by indefinitely persistent stability and homogeneity. This aqueous solution is thus devoid of suspended matter or coacervates, and is not a gel or gel-like. Indicative of the presence of such a stable, homogeneous aqueous solution is clearness or clarity, i.e., a lack of haze or cloudiness, or a distinct phase interface.

As the strongly cationic component of the polysalt complexes of the present invention, there may be employed any water soluble cationic polymer containing quaternary ammonium functional groups. Included among such cationic polymers are those wherein the quaternary ammonium functional group is carried as a pendant group to the principal polymer chain such as poly vinyl benzyl trimethyl ammonium chloride, poly-[alpha-(methylene trimethyl ammonium chloride) ethylene oxide] and poly methacryloloxyethyl trimethyl ammonium chloride; those wherein the quaternary ammonium functional group is incorporated in a cyclic structure which comprises a portion of the polymer backbone such as poly-(dimethyl diallyl ammonium chloride) and those wherein the quaternary ammonium functional group forms a part of the polymer chain, such cationic polymers being designated as, "ionenes". Included in this group, for example, are ionene polymers prepared from halo alkyl dialkyl amine monomer units, such as 3-ionene, poly-(dimethyl propyl)ammonium chloride, prepared from 3-chloropropyl dimethyl amine, and ionene polymers prepared from ditertiary amines and dihalides such as 3,4-ionene prepared from 1,3-bis-dimethylamino propane and 1,4-dichlorobutene. Other ionene polymers, of course, which are prepared similarly may be employed in the practice of this invention.

It is also intended to include within the scope of the strongly cationic component of the polysalt complexes of the present invention such tertiary-amine-containing polymer compositions as may, under proper conditions of pH, form quaternary ammonium salts, thereby resulting in the cationic polymers described above.

It should be noted that the cationic polymer may contain one or more other mer units without departing from the concept of this invention. For example, copolymers such as the copolymer of dimethyl diallyl ammonium chloride and diacetone acrylamide may be employed as the cationic component of the polysalt complexes of this invention. The ratio of mer units in such copolymers normally is determined by the quantity of cationic units necessary to impart the desired conductivity and/or the ratio of co-mer units needed to impart some other desired property.

The anionic components of the polysalt complexes of this invention in general comprise the conjugate base of a weak acid which has a pK value of 3 or greater. Two types of anionic materials may be employed successfully, either alone or together. The first type of anionic material comprises water soluble multifunctional carboxylic acid compounds. The expression "multifunctional carboxylic acid compounds" denotes simple, i.e., non-polymeric, compounds containing at least two carboxylic groups, to which the term "multifinctional" refers. The term was chosen to avoid the confusion with polymeric compositions that might be created by the use of terms such as "polycarboxylic". Included among such multifunctional carboxylic acid compounds are dicarboxylic acids such as glutaric acid, succinic acid and maleic acid, tri- and tetra-carboxylic acids and higher homologs such as 1,1,1-ethane tricarboxylic acid, 1,1,2-ethane tricarboxylic acid, 1,2,3-propane tricarboxylic acid, 1,2-dihydroxy-1,2,3-propane tricarboxylic acid, and benzene tetracarboxylic acid. These multifunctional carboxylic acids may also contain other groups such as ether linkages, hydroxy groups, ester groups, etc., so long as they contain two or more carboxy groups. The second type of anionic material comprises water soluble weakly anionic polymeric carboxylic acids such as polymers and copolymers of acrylic acid, maleic acid, fumaric acid, citraconic acid, itaconic acid and the like. Excluded, however, from such polymeric carboxylic acids, as well as from the multifunctional carboxylic acids described, are the fatty acids and poly-fatty acids, and polymers having more than two carboxyl groups in any single repeating mer unit.

In order to demonstrate the conditions under which the stable, homogeneous aqueous solutions of polysalt complexes of the present invention may be obtained, and under which they exist, a representative polysalt complex aqueous solution of the present invention was prepared and certain critical parameters were then varied. The polysalt complex comprised poly-dimethyl diallyl ammonium chloride, DMDAAC, as the strongly cationic quaternary ammonium polymer component, and polyacrylic acid, PAA, as the weakly anionic polymeric carboxylic acid. Five polysalt complex aqueous solutions designated herein as A, B, and C, D, and E, were prepared, containing equivalents ratios of PAA/DMDAAC of 0.35, 0.50, 1.0, 2.0, and 10.0. The poly (DMDAAC) was employed as a 33% by weight solution, and the PAA, employed as a 33% by weight solution, was the sodium salt of polyacrylic acid of molecular weight about 700 to 1,000, available commercially as Calnox 214 DN, from Milchem Company. As thus prepared, all five initial solutions were observed to be cloudy and to have a pH in the range of 6.9 to 7.0.

The prepared solutions were permitted to stand overnight, after which time the 10.0, 2.0 and 1.0 equivalent weight ratio solutions were observed to have separated into two distinct layers or phases. The 0.5 equivalent weight ratio solution had separated also, but to a much lesser extent.

Aliquot portions of 100 g. of each of the five prepared solutions were taken, and these aliquots were then adjusted to pH's in the range of 2 to 13, and also diluted to give overall polysalt complex concentrations in solution of from 33% down to 2.5% by weight. The character of the aliquot solutions resulting from each of the pH and concentration parameter variations was observed and recorded. The results obtained are summarized in the following tables of values.

TABLE A

| 33% By Weight Polysalt Solutions at pH 2 to pH 8 | | | | |
|---|---|---|---|---|
| Sample | Equivalent Weight Ratio PAA/DMDAAC[1] | ml of Acid or Base Required For pH Adjustment | Resultant pH | Appearance |
| A | 10:1 | 1 drop 50% NaOH | 8.0 | Cloudy |
| | | Unadjusted | 7.0 | Cloudy |
| | | 8 ml Conc. HCl | 5.5 | Clear |
| | | 10 ml Conc. HCl | 4.5 | Clear |
| | | 13 ml Conc. HCl | 4.0 | Clear |
| B | 2:1 | 1 drop 50% NaOH | 8.0 | Cloudy |
| | | Unadjusted | 7.0 | Cloudy |
| | | 5 ml Conc. HCl | 5.0 | Clearing |
| | | 8 ml Conc. HCl | 4.5 | Clear |
| C | 0.5:1 | 0.8 ml 1N NaOH | 8.0 | Cloudy |
| | | unadjusted | 6.9 | Cloudy |
| | | 2 ml of 10% HCl | 5.5 | Clear |
| | | 6 ml of 10% HCl | 4.5 | Clear |
| | | 10 ml of 10% HCl | 2.0 | Clear |
| D | 0.35:1 | 1 ml. 1N NaOH | 8.0 | Cloudy |
| | | Unadjusted | 7.0 | Cloudy |
| | | 1 ml of 10% HCl | 6.2 | Clear |
| | | 4 ml of 10% HCl | 5.5 | Clear |
| | | 8 ml of 10% HCl | 4.3 | Clear |
| | | 13 ml of 10% HCl | 2.2 | Clear |
| E | 1:1 | 1 ml. 1N NaOH | 8.0 | Cloudy |
| | | Unadjusted | 7.0 | Cloudy |
| | | 6 ml of 10% HCl | 5.5 | Slightly Cloudy |
| | | 7 ml of 10% HCl | 5.4 | Clear |
| | | 15 ml of 10% HCl | 3.5 | Cloudy |
| | | 20 ml of 10% HCl | 2.0 | Clear |

[1]Equivalent weight ratio = ratio of the number or fraction of equivalents (equivalent weights) of PAA to the number or fraction of equivalents (equivalent weights) of poly DMDAAC.

TABLE B

| 25% By Weight Polysalt Solutions at pH 7 to pH 13 | | | | |
|---|---|---|---|---|
| Sample | Equivalent Weight Ratio PAA/DMDAAC | Total Base Required For pH Adjustment | Resultant pH | Appearance |
| A | 10:1 | 5 drops of 50% NaOH | 7.0 | Clear |
| | | | 8.5 | Clear |
| | | | 9.2 | Clear |
| | | | 11.0 | Clear |
| | | | 12.5 | Clear |
| B | 2:1 | 10 drops of 50% NaOH | 7 | Clear |
| | | | 8 | Clear |
| | | | 9.5 | Clear |
| | | | 12.5 | Clear |
| E | 1:1 | 15 drops of 50% NaOH | 7 | Clear |
| | | | 8 | Clear |
| | | | 9 | Clear |
| | | | 11 | Clear |
| | | | 13 | Clear |
| C | 0.5:1 | 20 drops of 50% NaOH | 7 | Clear |
| | | | 8 | Clear |
| | | | 10 | Clear |
| | | | 12 | Clear |
| | | | 13 | Clear |

TABLE C

| Polysalts at Various Concentrations | | | |
|---|---|---|---|
| Sample | Equivalent Weight Ratio PAA/DMDAAC | % By Weight Concentration | Appearance |
| A | 10:1 | 33 | Cloudy |
| | | 25 | Clear |
| | | 15 | Clear |
| | | 10 | Clear (pH 7.5) |
| | | 5 | Cloudy |
| B | 2:1 | 33 | Cloudy |
| | | 25 | Clear |
| | | 15 | Clear |
| | | 10 | Clear (pH 7.4) |
| | | 5 | Cloudy |
| C | 0.5:1 | 33 | Cloudy |
| | | 25 | Clear |
| | | 15 | Clear |
| | | 10 | Clear (pH 7.2) |
| | | 5 | Cloudy (pH 7.4) |
| | | 2.5 | Cloudy |
| D | 0.35:1 | 33 | Cloudy |
| | | 25 | Clear |
| | | 15 | Clear |
| | | 10 | Clear (pH 7.2) |

TABLE C-continued

| Polysalts at Various Concentrations | | | |
|---|---|---|---|
| Sample | Equivalent Weight Ratio PAA/DMDAAC | % By Weight Concentration | Appearance |
| | | 5 | Clear |
| | | 2.5 | Cloudy |
| E | 1:1 | 33 | Cloudy |
| | | 25 | Clear |
| | | 15 | Clear |
| | | 10 | Clear (pH 7.5) |
| | | 5 | Cloudy |
| | | 2.5 | Cloudy |

The following examples are included to demonstrate both the practice and advantages derived from the practice of the present invention. However, it should be noted that these examples are for the purpose of illustration, merely, and no limitation is intended except as defined in the appended claims.

In the coating industry, a composition which includes a pigment, a binder and a conductive agent is commonly referred to as a coating color: this terminology will be utilized hereinafter. The subsequent examples illustrate two typical methods by which this invention may be practiced: (1) modification of the pre-formulated coating color; and (2) modification of the conductive polymer prior to formulation.

EXAMPLE 1

A coating color was prepared according to the following procedure: a 25 percent starch solution was prepared from hydroxyethylated starch and 360 grams $H_2O$. The mixture was cooked at 95° to 100° C. for fifteen minutes. A slip of 300 grams of clay (Alphagloss) in 270 grams $H_2O$ was prepared and added to the starch solution at about 50° C. with good stirring. Finally, 450 grams of 40 percent poly DMDAAC (dimethyl diallyl ammonium chloride) was added to produce a coating color having the following solids composition: poly DMDAAC, 30 percent; starch, 20 percent; clay, 50 percent, the pH of the color was 4 to 5.

The foregoing coating color (designated 17) was modified by addition of varying amounts of polyacrylic acid (MW = 50,000) and subsequently adjusting the pH to 7 to 9 with 5 percent NaOH. In each case, 150 grams of the standard coating was weighed into a beaker for modification. (150 grams of this coating color contains 0.112 M DMDAAC). The modification had essentially no effect on consistency or the overall "workability" of the resulting color.

TABLE I

| Coating Color 17 and HMW PAA[a] | | | | | |
|---|---|---|---|---|---|
| Sample Number | Eq. Wts.[b] PAA Added | Eq. Wts.[b] PAA/ Eq. Wts.[b] DMDAAC | Wt. % Total Polymer | Wt. % Poly DMDAAC | Brookfield[c] Viscosity |
| 8-A | 0.0112 | 0.10 | 11.3 | 10.8 | 1,025 |
| 8-B | 0.0234 | 0.21 | 11.2 | 10.2 | 1,325 |
| 8-C | 0.0358 | 0.32 | 11.2 | 9.8 | 1,325 |
| 12-D | 0.0684 | 0.61 | 11.3 | 7.0 | 1,475 |

[a]High molecular weight (50,000) polyacrylic acid. Brookfield viscosity of the unmodified coating color (17) was 625.
[b]Eq. Wts. = number or fraction of equivalents or equivalent weights.
[c]Brookfield viscosity of the coating color, spindle No. 2RV, 10 rpm.

To avoid or minimize the above slight viscosity increases noted in the coating color, a sample of low molecular weight, LMW, polyacrylic acid was then obtained and utilized as previously described (MW about 2500). The "workability" of the coating colors summarized in Table II, below, was equivalent to or better than that of the unmodified coating color. Relevant data are summarized in Table II.

TABLE II

| Coating Color 27 and LMW PAA[a] | | | | | |
|---|---|---|---|---|---|
| Sample Number | Eq. Wts. PAA Added | Eq. Wts. PAA/ Eq. Wts. DMDAAC | Wt. % Total Polymer | Wt. % Poly DMDAAC | Brookfield[c] Viscosity |
| 13-A | 0.0112 | 0.100 | 11.8 | 11.3 | 495 |
| 13-B | 0.0228 | 0.204 | 11.6 | 10.7 | 485 |
| 13-C | 0.0345 | 0.308 | 11.5 | 8.5 | 450 |
| 13-D | 0.0429 | 0.383 | 11.3 | 8.1 | 450 |

[a]Low molecular weight polyacrylic acid, MW = 2,500. Brookfield of the unmodified color (27) was 600 cps, color 27 was the same as color 17.
[b]Brookfield viscosity of the coating color, spindle No. 2LV, 30 rpm.

To determine the feasibility of cross-linking a coating color containing poly DMDAAC with a simple dicarboxylic acid, three samples of 150 grams each of coating color 17 were weighed out and modified via addition of varying amounts of a 4 percent by weight aqueous solution of succinic acid. The pH of the modified coating color was then adjusted to a range of 7 to 9.

TABLE III

| Coating Color 17 and Succinic Acid (SA) | | | | | |
|---|---|---|---|---|---|
| Sample Number | Eq. Wts. SA Added | Eg. Wts. SA/ Eq. Wts. DMDAAC | Wt. % Total Polymer | Wt. % Poly DMDAAC | Brookfield[a] Viscosity |
| 12-A | .00136 | .012 | 11.5 | 11.5 | 680 |
| 12-B | .0064 | .058 | 10.8 | 10.8 | 425 |

[a]Spindle No. 2LV, 30 rpm; coating color 17 = 625 cps.

EXAMPLE 2

Use of the foregoing procedures for modification of the coating color would require a two-stage addition during formulation. Since a single addition is preferable, a modified polymer (as compared to the previous modified coating colors) was prepared by adding LMW PAA directly to the cationic conductive polymer. The pH of the poly DMDAAC was about 5 to 6; the LMW PAA was added and stirred well to obtain a homogeneous solution of polymers.

TABLE IV

| Sample Number | Eq. Wts. Poly DMDAAC | Eg. Wts. PAA Added | Eg. Wts. PAA/ Eq. Wts. DMDAAC | Wt % Total Solids | Wt % Poly DMDAAC | Brookfield Viscosity |
|---|---|---|---|---|---|---|
| 19 | 1.222 | 0.497 | 0.442 | 30.5 | 25.4 | 2520[a] |
| 29-A | 0.850 | 0.085 | 0.100 | 34.0 | 32.5 | 3560[b] |
| 34-A | 0.647 | 0.032 | 0.050 | 34.7 | 34.0 | 4760[b] |
| 34-B | 0.647 | 0.129 | 0.200 | 31.6 | 34.4 | 3730[b] |

[a]Spindle No. 2LV, 6 rpm; Brookfield of the unmodified poly DMDAAC was 3580 cps (30.3% solids).
[b]Spindle No. 3LV, 12 rpm; Brookfield of the unmodified poly DMDAAC was 4200 cps (34.5% solids).

TABLE V

| | Modified Poly DMDAAC | | | | | |
|---|---|---|---|---|---|---|
| Sample Number | Eq. Wts. Poly DMDAAC | Eq. Wts. PAA Added | Eq. Wts. PAA/[b] Eq. Wts. DMDAAC | Wt. % Total Solids | Wt. % Poly DMDAAC | Brook-field[a] Viscosity |
| 15-A | 1.55 | 0.633 | 0.408 | 38.2 | 32.3 | 2150 |

[a]Brookfield viscosity of the polymer solution, spindle No. 3LV, 12 rpm.
(Brookfield viscosity of the unmodified poly DMDAAC was 2,200 cps).
[b]PAA used was Milchem AEP-231.

After modification, via addition of the 31 percent polyacrylic acid solution, the above modified polymer had a pH of 4 to 5.

Two other cationic conductive polymers were modified via formation of a partial polysalt with LMW PAA according to the preceding procedure. Although one polymer exhibited a notable increase in viscosity, both modified products were homogeneous at acidic pH. The viscosity of PACEO, poly[alpha-(methylene trimethyl ammonium chloride) ethylene oxide], did not change noticeably with the addition of the PAA; however, the viscosity of PVBTAC, polyvinyl benzyl trimethyl ammonium chloride, changed from 144 to 3,100 cps with addition of PAA.

unmodified poly DMDAAC. The sheets were coated via drawdowns with the appropriate wire-wound rod according to standard lab practices. Each sheet was dried in a photographic print dryer for one minute before and two minutes after coating. The coated sheets were then conditioned, at least overnight, at the specified humidity prior to evaluation.

Surface resistivity of a 3.375 inch diameter disc from the sheet was measured with a Keithley 610 B Electrometer. Solvent holdout was determined by contacting the sheet with the appropriate solvent/dye solution (toluene or kerosene) for ten seconds, immediately wiping the dye/solvent from the sheet, visually inspecting the other side and estimating the penetration. Estimation of the holdout was based on the TAPPI (Technical Association of the Pulp and Paper Industry) standard chart (100 percent minus percent penetration = percent holdout).

TABLE VI

| | Other Cationic Conductive Polymers, Plus PAA | | | | | | |
|---|---|---|---|---|---|---|---|
| Sample Number | Cationic Polymer | Eq. Wts. Cationic | Eq. Wts. PAA Added | Eq. Wts. PAA / Eq. Wts. Cationic | Wt.% Total Solids | Wt.% Cationic | Brookfield[c] Viscosity |
| 16 | PACEO[a] | 0.417 | 0.167 | 0.40 | 39.7 | 33.4 | 76 |
| 17 | PVBTAC[b] | 0.322 | 0.129 | 0.40 | 33.5 | 29.6 | 3100 |

[a]Poly[alpha-(methylene trimethyl ammonium chloride)ethylene oxide].
[b]Polyvinyl benzyl trimethyl ammonium chloride.
[c]Spindle No. 3LV, 30rpm.

Table VII describes samples prepared with poly DMDAAC and glutaric acid (GA) to establish (via subsequent evaluations) that a polysalt formed by poly DMDAAC and a dicarboxylic acid would provide the properties sought.

The coatweights included in the subsequent tables were based on total solids of the following formulation: 30 percent conductive polymer/50 percent clay/20 percent hydroxyethylated starch. The data in Tables VIII – X were obtained using the aforementioned relatively "open" raw stock on which solvent holdout is difficult to attain.

TABLE VII

| | Poly DMDAAC Plus Glutaric Acid(GA) | | | | | |
|---|---|---|---|---|---|---|
| Sample Number | Eq. Wts. Poly DMDAAC | Eq. Wts. GA Added | Eq. Wts. GA/ Eq. Wts. DMDAAC | Wt. % Total Solids | Wt. % Poly DMDAAC | Brookfield Viscosity[a] |
| 31-A | 0.681 | 0.068 | 0.100 | 36.4 | 35.0 | 3630 |
| 31-B | 0.681 | 0.148 | 0.218 | 36.4 | 33.4 | 3130 |
| 31-C | 0.681 | 0.204 | 0.300 | 36.4 | 32.4 | 2860 |

[a]Spindle No. 3LV, 12 rpm; Brookfied of the unmodified Poly DMDAAC was 4150 cps (36.5 percent solids).

EXAMPLE 3

To illustrate some of the advantages derived from the practice of the present invention, the modified coating colors were coated on sheets of a relatively "open" rosin sized raw stock and compared to sheets prepared in like manner using a conductive coating based on

TABLE VIII

| Surface Resistivity and Solvent Holdout of HMW PAA/Poly DMDAAC[a] | | | | | |
|---|---|---|---|---|---|
| Conductive Polymer in Formulation | Total Coat Wt. Lbs./3000 ft$^2$ | Surface Resistivity (Ohms/Sq.)[c] 29% RH $\times 10^{-8}$[b] | 50% RH $\times 10^{-7}$[b] | Percent Holdout Toluene | Isopar G |
| 17 | 1.91 | 7.74 | 5.34 | 5 | 0 |
| (Control) | 1.91 | 3.81 | 3.34 | 5-10 | 0 |
| | 2.11 | — | 4.86 | 15 | 0 |
| 8-A | 1.51 | 7.32 | 4.86 | 15 | 0 |
| | 1.91 | — | 7.63 | 40 | 5-10 |
| | 2.31 | — | 6.94 | 65 | 5-10 |
| 8-B | 1.65 | 4.86 | 4.11 | 20 | 0 |
| | 2.45 | 7.12 | 4.86 | 85 | 70 |
| 8-C | 1.98 | 6.76 | 5.34 | 50 | 30 |
| | 2.19 | 8.60 | 6.76 | 80 | 40 |

[a]High molecular weight polyacrylic acid/poly DMDAAC.
[b]Tabularized value of 7.74 translates to 7.74 $\times 10^{-8}$.
[c]As is known in the art, the term "ohms per square" requires no dimension.

TABLE IX

| Resistivity and Solvent Holdout of LMW PAA/Poly DMDAAC[a] | | | | | |
|---|---|---|---|---|---|
| Conductive Polymer in Formulation | Total Coat Wt. Lbs./3000 ft$^2$ | Surface Resistivity (Ohms/Sq.) 18% RH $\times 10^{-9}$ | 50% RH $\times 10^{-7}$ | Percent Holdout Toluene | Isopar G |
| 27 | 1.91 | 1.1 | 3.0 | 15 | 0 |
| (Control) | 2.54 | 1.0 | 2.1 | 35 | 0 |
| 13-B | 2.24 | 1.1 | 4.1 | 30 | 0 |
| | 2.57 | 0.91 | 3.6 | 60 | 0 |
| 13-C | 1.65 | 1.8 | 8.0 | 80 | 0 |
| | 2.57 | 1.3 | 5.3 | 75 | 0 |
| 13-D | 1.39 | 1.4 | 6.1 | 75 | 0 |
| | 1.78 | 0.91 | 6.4 | 80 | 5 |
| | 2.05 | 1.3 | 6.5 | 80 | 5 |
| | 2.11 | 0.95 | 3.8 | 80 | 5 |

[a]Low molecular weight polyacrylic acid/poly DMDAAC.

TABLE X

| Resistivity and Solvent Holdout of Succinic Acid/Poly DMDAAC | | | | | |
|---|---|---|---|---|---|
| Conductive Polymer in Formulation | Total Coat Wt. Lbs./3000 ft.$^2$ | Surface Resisitivity (Ohms/Sq.) 18% RH $\times 10^{-9}$ | 50% RH $\times 10^{-8}$ | Percent Holdout Toluene | Isopar G |
| 27 | 1.91 | 1.1 | 3.0 | 15 | 0 |
| (Control) | 2.54 | 1.0 | 2.1 | 35 | 0 |
| 12-A | 1.58 | 0.85 | 2.54 | 20 | 0 |
| | 2.31 | 0.68 | 1.72 | 35 | 0 |
| | 2.44 | 0.99 | 2.54 | 50 | 0 |
| 12-B | 2.24 | 1.21 | 4.45 | 40 | 0 |
| | 2.38 | 1.44 | 4.86 | 60 | 0 |
| 12-D | 1.45 | 11.9 | 28.1 | 20 | 0 |
| | 1.72 | 8.61 | 18.4 | 35 | 0 |
| | 2.18 | 6.85 | 14.8 | 80 | 0 |
| | 2.51 | 3.81 | 9.7 | 80 | 0 |

The data in Table XI was obtained using a relatively "tight", i.e. surface sized, commercially available raw stock. Holdout prior to application was, however, 0% to both toluene and isopar (parafinic) solvents. The typical formulation previously described was employed.

TABLE XI

| Resistivity and Solvent Holdout of Glutaric Acid/Poly DMDAAC | | | | | |
|---|---|---|---|---|---|
| Conductive Polymer in Formulation | Total Coat Weight Lbs./3000 ft.$^2$ | Surface Resistivity Ohms/Sq. 18% RH $\times 10^{-10}$ | 50% RH $\times 10^{-8}$ | Percent Holdout Toluene | Isopar G |
| Poly | 0.70 | 4.5 | 2.5 | 90 | 20 |
| DMDAAC | 1.50 | 1.3 | 0.90 | 96 | 80 |
| (Control) | 2.21 | 0.55 | 0.57 | 98 | 85 |
| 31-B | 0.83 | 16. | 2.1 | 94 | 75 |
| | 1.49 | 2.4 | 1.1 | 98 | 90 |
| | 2.16 | .91 | .27 | 98 | 90 |
| 31-C | 0.60 | 8.2 | 2.7 | 90 | 40 |
| | 1.83 | .91 | .62 | 96 | 80 |

EXAMPLE 4

Tackiness of the conductive coated sheets described in Example 3 was evaluated by the moist palm method. Although this test is qualitative in nature, it is quite sensitive to differences in tack and applied within a series of samples permits accurate ranking of the tackiness of the respective sheets. This test is commonly and widely used in the industry to evaluate this property. The findings using the moist palm method demonstrated that in all cases, the sheet which has been coated with a formulation containing the polysalts described herein exhibited significantly less tack than the control sheets coated with the formulation based on unmodified poly DMDAAC.

EXAMPLE 5

It is commonly known that cationic polymers such as poly DMDAAc exhibit very poor filmability on synthetic (plastic) substrates. It has been demonstrated that modification of cationic polymers according to the principles of this invention provides a product which exhibits (1) extremely good filmability on plastic substrates (2) very low tack films and (3) highly conductive film. In the subsequent table, a modified cationic polymer (Sample Number 19) was coated from both 10% aqueous and 10% methanolic solutions. Tack was very low for all coatings.

TABLE XII

| Coat Weight Lbs./3000 ft.$^2$ | Modified Cationic Polymer (19) as Conductive Agent on Synthetic Substrates: Coating Medium | Substrate | Relative Humidity | Resistivity Ohms/Square |
|---|---|---|---|---|
| 0.7 | $H_2O$ | Mylar | 28% | $4.9 \times 10^8$ |
| | MeOH | Mylar | 28% | $7.3 \times 10^8$ |
| 0.7 | $H_2O$ | Vinyl Acetate | 21% | $2.1 \times 10^{10}$ |
| | MeOH | Vinyl Acetate | 21% | $6.3 \times 10^9$ |
| 0.7 | $H_2O$ | Polyvinyl Chlofire | 21% | $2.8 \times 10^{12}$ |
| | MeOH | Polyvinyl Chloride | 21% | $2.0 \times 10^{10}$ |
| 0.7 | $H_2O$ | Polyethylene | 21% | $2.2 \times 10^{10}$ |
| | MeOH | Polyethylene | 21% | $>10^{16}$ |

Note: No control is shown because the unmodified cationic poly DMDAAC did not film well enough (severe mottling was observed) to provide an on scale resistance reading. The resistance reading obtained ($>10^{16}$) was essentially that of the substrate.

EXAMPLE 6

It has also been demonstrated that copolymers containing sufficient cationic mer units to impart the desired conductivity may be employed in the practice of this invention. It will be appreciated by those skilled in the art that the ability to utilize copolymers in the practice of this invention provides the capability to obtain other desirable properties or to otherwise enhance the properties described herein. For example, a 90/10 w/w copolymer of DMDAAC/diacetone acrylamide mixed with 10% by weight of a hydrolyzed maleic anhydride/styrene copolymer marketed by American Cyanimid Co., (composition hereinafter designated as Polymer 23) provides excellent, low tack films on the synthetic substrates previously noted.

TABLE XIII

| Coatweight Lbs/3000 ft$^2$ | Modified Cationic Polymer (23) as Conductive Agent on Synthetic Substrates: Coating Medium | Substrate | Relative Humidity | Resistivity Ohms/Square |
|---|---|---|---|---|
| 0.3 | $H_2O$ | Mylar | 10% | $3.6 \times 10^{10}$ |
| 0.3 | MeOH | Mylar | 10% | $3.3 \times 10^{10}$ |
| 0.3 | $H_2O$ | Vinyl Acetate | 10% | $3.1 \times 10^{10}$ |
| 0.4 | MeOH | Vinyl Acetate | 10% | $1.9 \times 10^{12}$ |
| 0.4 | $H_2O$ | Poly Vinyl Chloride | 10% | $7.4 \times 10^9$ |
| 0.3 | MeOH | Poly Vinyl Chloride | 10% | $5.7 \times 10^{13}$ |

EXAMPLE 7

As expected, water leachability of coating colors is decreased by cross-linking (either ionic or covalent or combinations thereof) and is inversely proportional to the ratio of polysalt present. Evaluation of holdout to a 0.1% alum solution using a Calgon Test cell demonstrated that a formulation containing polymer 29A (Table IV above) prevented penetration of the alum solution for 20% longer than did the control.

As may be seen from the foregoing examples, the polysalt complexes of this invention may be employed to electroconductivize various substrates including paper and plastics. In the preparation of such electroconductivized materials, the polysalt complexes of this invention may be applied to the material to be electroconductivized by methods conventional for such purpose, e.g. by coating, dipping, brushing, wet end addition, etc. The polysalt complexes of this invention may be applied to a substrate or introduced into a system as aqueous solutions, of course. They may also be applied or introduced as lower alkanol solutions, employing as a solvent methanol, ethanol, isopropanol, butanol and so forth. The amount of polysalt complex applied will vary widely depending upon such considerations as the particular polysalt complex being used, the nature of the material being electroconductivized and the degree of electroconductivity desired. In general, however, the polysalts of this invention will be employed in amounts ranging from about 0.5 to 3.0 pounds per 3,000 square feet of material to be electroconductivized. In some cases, as little as 0.1 pound per 3,000 square feet will be satisfactory. There appears to be no operative upper limit to the amount of polysalt employed except to the extent that this is determined by economics. It will be appreciated therefore that the overall range of from about 0.1 to 3.0 pounds per 3,000 square feet is a statement simply of the amount of polysalt complex required to confer electroconductive properties to usual substrates.

Although the instant invention has been described in the foregoing specification particularly in terms of electroconductive polysalt complexes wherein the water soluble strongly cationic component is quaternary ammonium polymer, it will be obvious to one skilled in the art from a study of the specification that water soluble strongly cationic phosphonium and/or sulfonium polymers could be substituted for the quaternary ammonium polymers specifically described. Further, it will be obvious to those skilled in the art that polysalt complexes formed by the ionic cross-linking of a water soluble strongly anionic polymer, such as, for example, poly(-sulfostyrene), poly(allyl sulfonic) acid, sulfonated urea-formaldehyde resin, sulfonated polymethylolacrylamide and the like, with a water soluble weakly cationic polymer, such as, for example, polyvinylamine, polyethyleneimine, acrylamide-vinylpyridine copolymers, poly(diethylaminoethyl acrylate) and the like, can be substituted for the polysalt complexes described above. Applicants consider all such obvious modifications to be the full equivalent of the polysalts specifically described herein and to fall within the scope of the instant invention.

What is claimed is:

1. The method of making conductivized materials which comprises applying to the material to be conductivized an effective quantity of an electroconductivizing agent comprising a polysalt complex consisting essentially of (A) a cationic component of a water soluble, strongly cationic quaternary ammonium homopolymer or copolymer of poly-(dimethyl diallyl ammonium chloride); and (B) an anionic component of a water soluble, weakly anionic material comprising (a) a water soluble, weakly anionic polymeric carboxylic acid selected from homopolymers and copolymers of acrylic acid and of maleic acid; or (b) a water soluble, weakly anionic multifunctional carboxylic acid selected from maleic acid, succinic acid and glutaric acid; or (c) mixtures of (a) and (b); said weakly anionic materials being characterized by having a pK value greater than 3; and wherein the ratio of equivalents of the anionic component to the cationic component is 0.01 to 10.0, and the polysalt complex forms a stable, homogeneous aqueous solution.

2. The method of claim 1 wherein the material to be conductivized is paper.

3. The method of claim 1 wherein the material to be conductivized is synthetic polymer.

4. The method of claim 1 wherein the polysalt complex employed therein the cationic component is a copolymer of dimethyl diallyl ammonium chloride and diacetone acrylamide, and the anionic component is a copolymer of hydrolyzed maleic anhydride and styrene.

5. A polysalt complex consisting essentially of (A) a cationic component of a water soluble, strongly cationic quaternary ammonium homopolymer or copolymer of poly-(dimethyl diallyl ammonium chloride); and (B) an anionic component of a water soluble, weakly anionic material comprising (a) a water soluble, weakly anionic polymeric carboxylic acid selected from homopolymers and copolymers of acrylic acid and of maleic acid; or (b) a water soluble, weakly anionic multifunctional carboxylic acid selected from maleic acid, succinic acid and glutaric acid; or (c) mixtures of (a) and (b); said water soluble, weakly anionic material being characterized by having a pK value greater than 3; and wherein the ratio of equivalents of the anionic component to the cationic component of the polysalt complex is 0.01 to 10.0, and the polysalt complex forms a stable, homogeneous aqueous solution.

6. The polysalt complex of claim 5 wherein the cationic component is a copolymer of dimethyl diallyl ammonium chloride and diacetone acrylamide, and the anionic component is a copolymer of hydrolyzed maleic anhydride and styrene.

* * * * *